United States Patent [19]

Lee

[11] 4,423,913

[45] Jan. 3, 1984

[54] DISPLAY AND STORAGE ASSEMBLY UTILIZING A PLURALITY OF INTERCHANGEABLE STACKABLE BINS

[76] Inventor: William J. Lee, 19290 Orchard Heights, South Bend, Ind. 46614

[21] Appl. No.: 317,923

[22] Filed: Nov. 3, 1981

[51] Int. Cl.[3] ..... A47B 87/00; F16B 12/00

[52] U.S. Cl. ..... 312/107; 312/111; 312/118; 312/198; 211/194

[58] Field of Search ..... 312/107, 111, 140, 263, 312/117, 118; 211/194; 206/44.12

[56] References Cited

U.S. PATENT DOCUMENTS

| | | | |
|---|---|---|---|
| 1,252,816 | 1/1918 | Kuehl | 312/107 |
| 1,983,307 | 12/1934 | Regenhardt | 312/107 |
| 3,131,829 | 5/1964 | Masser | 312/107 |
| 3,374,917 | 3/1968 | Troy | 312/117 |
| 3,567,302 | 3/1971 | Carlson | 312/198 |
| 3,986,756 | 10/1976 | Kranich | 312/117 |
| 3,999,818 | 12/1976 | Schankler | 312/107 |
| 4,099,626 | 7/1978 | Magnussen, Jr. | 211/194 |
| 4,175,807 | 11/1979 | Kranich et al. | 312/118 |
| 4,227,758 | 10/1980 | Clare | 312/107 |

FOREIGN PATENT DOCUMENTS

| | | | |
|---|---|---|---|
| 567011 | 2/1924 | France | 312/107 |

*Primary Examiner*—Victor N. Sakran

*Attorney, Agent, or Firm*—Eugene C. Knoblock

[57] ABSTRACT

A display and storage assembly constituting a plurality of interlocking stackable bins with each bin having a top, bottom and opposed sides incorporating fasteners which permit the bins to be interlocked in a juxtaposed side by side relationship.

4 Claims, 12 Drawing Figures

FIG. 9
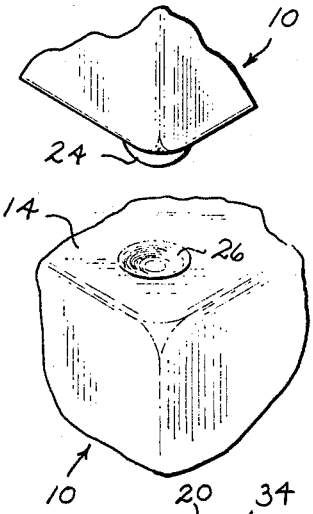
FIG. 10
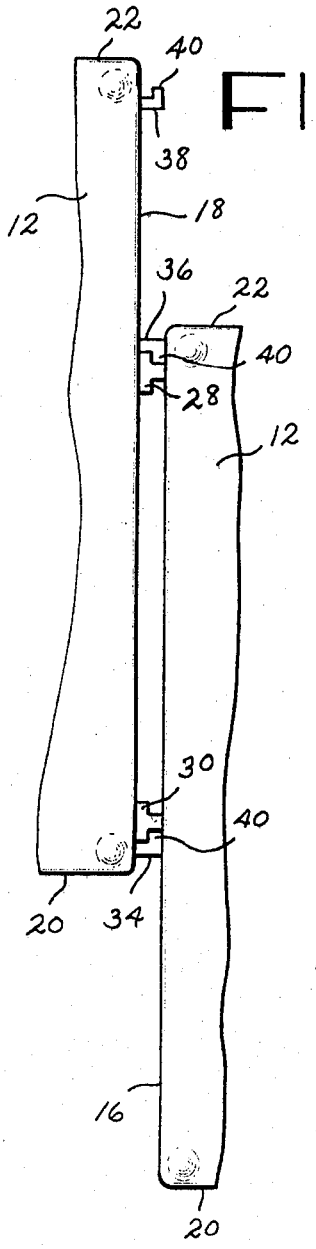
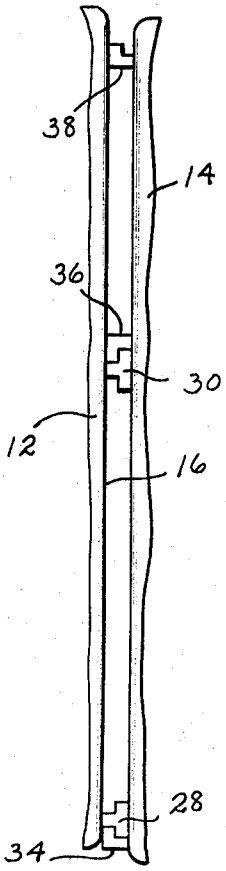
FIG 12
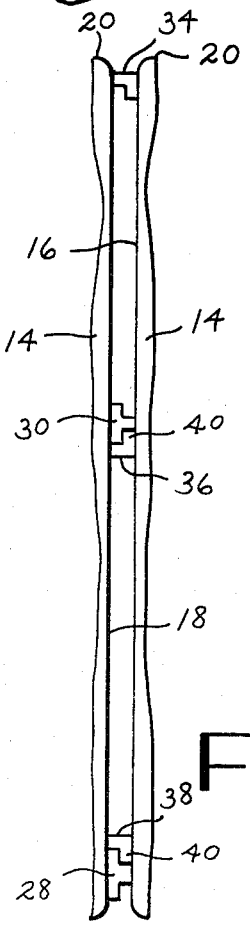
FIG. 11

DISPLAY AND STORAGE ASSEMBLY UTILIZING A PLURALITY OF INTERCHANGEABLE STACKABLE BINS

SUMMARY OF THE INVENTION

This invention relates to a display and storage assembly and will have specific application to a method and means by which a plurality of individual bins can be stacked and interlocked.

Display and storage bin assemblies of the general type of this invention are illustrated in U.S. Pat. No. 3,986,756 with a more specific arrangement and construction of the bins being shown in U.S. Pat. No. 4,175,807. In this invention the bins are constructed in a unique manner which incorporates the use of fasteners at the bin side walls. The type and location of these fasteners allow the bins to be offset, as shown in the above two mentioned prior art patents, or permit the bins to be mounted with the bin ends in a generally aligned or flush relationship and the openings in the bins being all at one side of the assembly or alternatively positioned at opposite sides of the assembly.

Accordingly, it is an object of this invention to provide a display and storage assembly which consists of a plurality of interlocking stackable bins.

Another object of this invention is to provide a display and storage assembly utilizing a plurality of bins which can be interlocked and stacked together in selected versatile orientations.

Still another object of this invention is to provide a display and storage assembly which utilizes a plurality of interlocking stackable bins and which can be simply assembled and disassembled.

And still another object of this invention is to provide a display and storage assembly which consists of a plurality of individual bins and which is of durable construction.

Other objects of this invention will become apparent upon a reading of the following description.

BRIEF DESCRIPTION OF THE DRAWINGS

A preferred embodiment of this invention has been chosen for purposes of illustration and description wherein:

FIG. 9 is a fragmentary detailed view of corresponding corners of two separate bins of the assembly showing a pimple and dimple method of interlock between upper and lower bins when stacked upon each other.

FIG. 10 is a fragmentary top plan view of two bins interlocked together in the orientation illustrated in FIG. 2.

FIG. 11 is a fragmentary plan view of two bins shown interlocked in a second orientation.

FIG. 12 is a fragmentary plan view of two bins shown interlocked in a third orientation, as shown in FIG. 1.

DESCRIPTION OF THE PREFERRED EMBODIMENT

Figure 1:
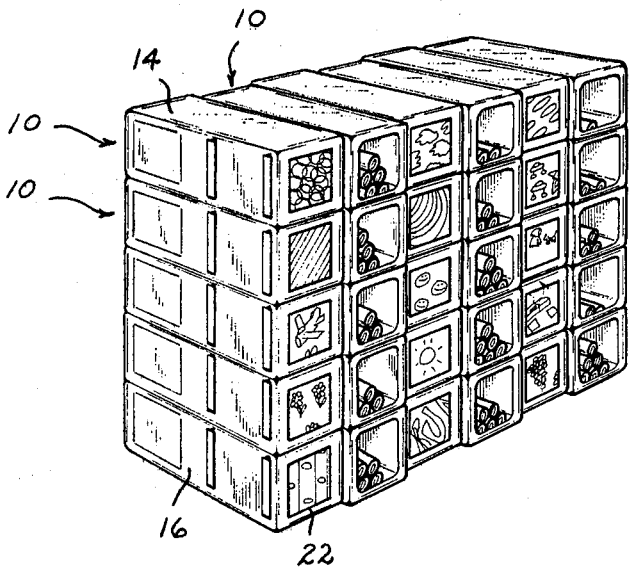
FIG. 1 is a perspective view of the assembly showing the bins thereof in one orientation.

The preferred embodiment illustrated is not intended to be exhaustive or to limit the invention to the precise form disclosed. It is chosen and described in order to best explain the principles of the invention and its application and practical use to thereby enable others skilled in the art to best utilize the invention.

Each bin 10 includes, as the bin is oriented in FIGS. 3–6 and 8, a top 12, a bottom 14, a side 16, an opposite side 18, and ends 20 and 22, all defining an enclosed storage compartment. In the illustrated embodiment of bin 10 only end 20 is open. If desired, depending upon the need of bin 10, opposite end 22 could also be open. In describing bin 10, reference is made to parts 12 and 14 as being a top and a bottom, respectively. It is to be understood, though, that in stacking bins 10 the orientation of parts 12 and 14 can be reversed with the bins being inverted from the orientation shown in FIG. 5 depending upon the form that the bin assembly is to take. Bins 10 may be formed from the molded fiber glass or shape-retaining plastic composition.

Top 12 of each bin is provided with a pimple or protrusion 24 at each corner, while bottom 14 of the bin is provided with a cavity or indentation 26 at each corner. During stacking of bins 10, the protrusions 24 of the bins extend into or fit complementally within indentations 26 of the adjacent upper or lower bins to add rigidity to the assembly and to prevent horizontal sliding movement of one bin relative to the other.

Side 16 of each bin 10 includes a pair of spaced parallel vertical fasteners 28 and 30. Each fastener 28, 30 extends for a substantial portion of the height of the side and has a T-shaped cross-sectional configuration. Fastener 28 is located near end 22 of the bin and fastener 30 is located near the center of the bin.

Figure 2:
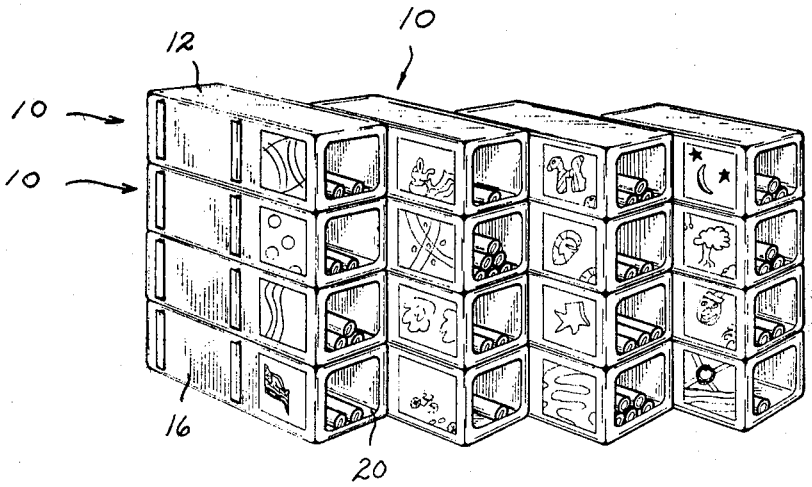
FIG. 2 is a perspective view of the assembly showing the bins thereof in a second orientation.
Figure 3:
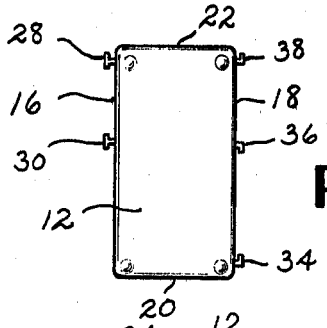
FIG. 3 is a top view of a bin utilized in the assembly.
Figure 4:
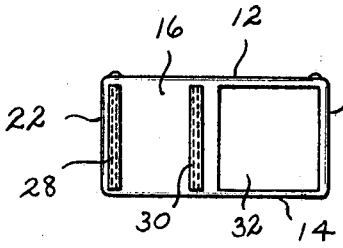
FIG. 4 is one side view of the bin utilized in the assembly.
Figure 5:
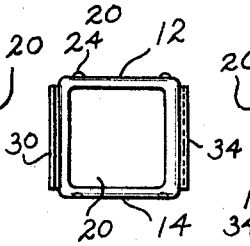
FIG. 5 is one end view of the bin utilized in the assembly.
Figure 6:
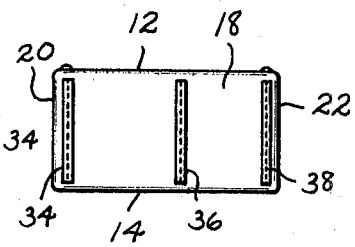
FIG. 6 is another side view of the bin utilized in the assembly.
Figure 8:
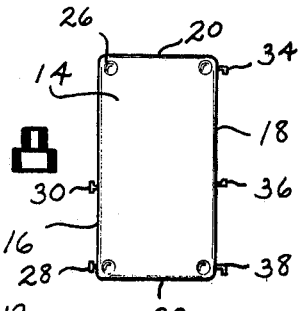
FIG. 8 is a bottom view of the bin utilized in the assembly.

As a matter of accommodation, each bin 10 is provided with a display area 32 in its side 16 which enables fabric material, a picture, or other type of illustrative or advertising medium to be applied to the bin and which is visible as illustrated in FIG. 2 when the bins are offset in their assembly. In FIGS. 1 and 2 the bins are shown retaining rolls of wallpaper with the wallpaper design being applied over areas 32 or ends 22 to enable the user of the display and storage assembly to know what is contained within each bin or the next adjacent bin as the case may be.

Side 18 of each bin 10 includes three parallel spaced vertical fasteners 34, 36 and 38. Each of the fasteners 34–38 has an inverted L-shape cross-sectional configuration and extends along a substantial portion of the height of side 18 of the bin. Fastener 34 is located adjacent the end 20 of the bin with its lip 40 being in-turned. Fastener 36 is located near the center of the bin and has its lip 40 out-turned, directed toward opposing lip 40 of fastener 34. Fastener 38 of the bin is located adjacent of the end 22 and has its lip 40 out-turned and oppositely extending from lip 40 of fastener 36.

Figure 7:
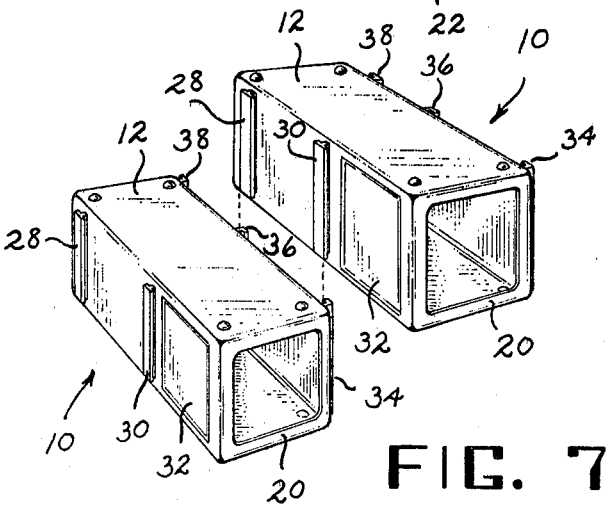
FIG. 7 is a perspective view showing two bins of the assembly being fitted together in the orientation illustrated in FIG. 2.

Bins 10 may be interlocked together in a side by side relationship through the engagement of fasteners 28, 30 of one bin with a selected two of the three fasteners 34–38. To assemble and stack the bins as shown in the FIG. 2 assembly, fasteners 28 and 30 of one bin are fitted between fasteners 34 and 36 of the adjacent bin, as illustrated in the FIG. 7 and as shown in the FIG. 10. The spacing between fasteners is such that the lips 40 of the fasteners 34 and 36 underlie the flanged head of fasteners 28 and 30 of the adjacent bin. Therefore, each of the vertical rows of bins illustrated in the assembly of FIG. 2 is connected to the next adjacent vertical row of bins by the interlocking engagement of fasteners 28 and 30 of one bin and fasteners 34 and 36 of the next horizontally located bin.

In assembling bins 10 into the assembly configuration shown in FIG. 1, flanges 28 and 30 of one bin are again fitted between fasteners 34 and 36 of the adjacent bin, but with one of the two adjacent bins inverted so that flange 38 of the adjacent bin is positioned against side wall 16 of the interlocked bin. In this assembly the bins 10 in one vertical row are connected to the next vertical row of bins 10 by the engagement of fasteners 28, 30, 34, 36, such as illustrated in FIG. 12.

A third possible assembly of bins 10 is one in which ends 20 of the bins face the same direction and are aligned in the interlocking form illustrated in FIG. 11. In this assembly, fasteners 36 and 38 of one bin 10 are fitted between fasteners 28 and 30 of the adjacent bin 10 with lips 40 of fasteners 36 and 38 underlying the flanged head of fasteners 28 and 30.

In the manner above described bins 10 with their unique interlocking fasteners 28–38 allow multiple oriented bin assemblies to be simply and rapidly formed and disassembled to accommodate various display and storage uses. It is to be understood that the invention is not to be limited, though, to the details above given but may be modified within the scope of the appended claims.

What I claim is:

1. A display and storage assembly comprising a plurality of interlocking stackable bins; each bin having a top, bottom and opposite first and second sides extending between ends of the bin to define a storage compartment therein; said first side of each bin having three longitudinally spaced vertically oriented fasteners protruding from the exterior of the side; said second side of each bin having two longitudinally spaced vertically oriented fasteners protruding from the exterior of the side; said second side two fasteners of one said bin being interlockable with one of two pairs of said first side three fasteners of another bin with said one bin second side and said another bin first side being juxtaposed in a first relative position; said second side two fasteners of said one bin being interlockable with a second of said two pairs of said first side three fasteners of said another bin sith said one bin second side and said another bin first side being juxtaposed in a second relative position.

2. A display and storage assembly comprising a plurality of interlocking stackable bins; each bin having a top, bottom and opposite first and second sides extending between ends of the bin to define a storage compartment therein; said first side of each bin having three longitudinally spaced vertically oriented fasteners protruding from the exterior of the side; said second side of each bin having two longitudinally spaced vertically oriented fasteners protruding from the exterior of the side; said second side two fasteners of one said bin being interlockable with either of two pairs of said first side three fasteners of another said bin with said one bin second side and said another bin first side being juxtaposed, said second side two fasteners of each bin located one near the longitudinal center and one adjacent an end of the bin; said first side three fasteners located one near the longitudinal center and one adjacent each end of the bin; said one bin being positioned in one longitudinal location relative to said another bin when said second side two fasteners of the one bin interlock with the center located fastener and a one end located fastener of said first side three fasteners of the another bin; said one bin being positioned in another longitudinal location relative to said another bin when said second side two fasteners of the one bin interlock with the center located fastener and the other one end located fastener of said first side three fasteners of the another bin.

3. The assembly of claim 2 wherein second side two fasteners of each bin are each T-shaped in cross-section having oppositely extending flange parts; said first side three fasteners of each bin each having an inverted L-shaped cross-section terminating in a lip; the lips of the center and said one end located fasteners of said first side three fasteners of said another bin being in-turned and opposed to underlie the flange parts of the second side two fasteners of said one bin when the flange parts are fitted between the center and one end located fastener lips to interlock said one and another bins together; the lips of the center and said other end located fasteners of said first side three fasteners of said another bin being out-turned and oppisitely extending to underlie the flange parts of the second side two fasteners of said one bin when said last mentioned lips are fitted between said last mentioned flange parts to interlock said one and another bins together.

4. The assembly of claim 2 wherein one of said top and bottom of each bin includes protrusions and the other of said top and bottom of each bin having indentations corresponding in horizontal location to said protrusions; the protrusions of said one bin fitting into the indentations of said another bin to interlock the bins in vertical orientation.

* * * * *